US009793645B2

(12) United States Patent
Yudate

(10) Patent No.: US 9,793,645 B2
(45) Date of Patent: Oct. 17, 2017

(54) SEAL MEMBER AND CONNECTOR

(71) Applicant: YAZAKI CORPORATION, Tokyo (JP)

(72) Inventor: Takahiro Yudate, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/382,777

(22) Filed: Dec. 19, 2016

(65) Prior Publication Data

US 2017/0179636 A1 Jun. 22, 2017

(30) Foreign Application Priority Data

Dec. 22, 2015 (JP) ..... 2015-249846

(51) Int. Cl.
*H01R 4/28* (2006.01)
*H01R 13/52* (2006.01)
*H01R 4/18* (2006.01)

(52) U.S. Cl.
CPC ..... *H01R 13/5208* (2013.01); *H01R 4/18* (2013.01)

(58) Field of Classification Search
CPC ..... H01R 13/426; H01R 4/18; H01R 13/521; H01R 13/5208
USPC ..... 439/521
See application file for complete search history.

(56) References Cited

U.S. PATENT DOCUMENTS 5,145,410 A * 9/1992 Maejima ..... H01R 13/5208 439/274
5,410,105 A * 4/1995 Tahara ..... H01R 4/70 156/49
8,100,716 B2 * 1/2012 Yahya ..... H01R 13/5208 439/587
8,337,244 B2 * 12/2012 Sawamura ..... H01R 13/5208 439/271
8,647,132 B2 * 2/2014 Kuroda ..... H01R 13/5208 439/271
2005/0245130 A1 * 11/2005 Shiga ..... H01R 13/5208 439/587
2010/0273353 A1 * 10/2010 Yahya ..... H01R 13/5208 439/587
2015/0333416 A1 * 11/2015 Kihara ..... H01R 4/20 439/877

FOREIGN PATENT DOCUMENTS

JP H04-058975 U 5/1992
JP 2005-317385 A 11/2005

* cited by examiner

*Primary Examiner* — Abdullah Riyami
*Assistant Examiner* — Nader Alhawamdeh
(74) *Attorney, Agent, or Firm* — Metrolexis Law Group, PLLC

(57) ABSTRACT

A seal member includes a plurality of wire insertion holes arranged in parallel along both directions orthogonal to each other, a plurality of block parts each of which is divided to a block having at least a plurality of wire insertion holes, and a connecting part which is configured so as to connect between the adjoining block parts and have a thickness thinner than wall thicknesses of the block parts.

14 Claims, 4 Drawing Sheets

SEAL MEMBER AND CONNECTOR

CROSS REFERENCE TO RELATED APPLICATION

The present application is based on, and claims priority from Japanese Patent Application No. 2015-249846, filed Dec. 22, 2015, the disclosure of which is hereby incorporated by reference herein in its entirety.

BACKGROUND

Technical Field

The present application relates to a seal member for preventing intrusion of water and the like into a housing, and a connector using the seal member.

Related Art

A connector using a seal member in a first conventional example is illustrated in FIG. 4 (refer to JP 2005-317385 A). In FIG. 4, the connector 50 includes a first connector housing 51, the seal member 52 in the first conventional example, and a second connector housing 53. The first connector housing 51 includes terminal accommodating chambers 51*a* and a seal-member accommodating chamber 51*b* continuing to the terminal accommodating chambers 51*a*. The seal member 52 is arranged in the seal-member accommodating chamber 51*b*. The second connector housing 53 is fitted to the first connector housing 51 and holds the seal member 52 so as not to depart from the seal-member accommodating chamber 51*b*.

The seal member 52 is made of rubber and includes a number of wire insertion holes 52*a* arranged in parallel along both directions orthogonal to each other. The seal member 52 is also provided, in the vicinity of each wire insertion hole 52*a*, with positioning holes 52*b*. Into the positioning holes 52*b*, there are inserted positioning projections 51*c* of the first connector housing 51 and positioning projections (not illustrated) of the second connector housing 53.

A terminal (not illustrated) connected to a wire is accommodated in each of the terminal accommodating chambers 51*a* of the first connector housing 51 as the terminal penetrates through each of the wire insertion holes 52*a* of the seal member 52. The wire connected to the terminal is closely accommodated in each of the wire insertion holes 52*a*. Consequently, water and the like are suppressed from entering into the terminal accommodating chambers 51*a* of the first connector housing 51 along the wires led out from the second connector housing 53.

Meanwhile, when the wires are closely accommodated in the wire insertion holes 52*a*, the seal member 52 is elastically deformed since the wire insertion holes 52*a* are enlarged in their diameters. Then, the positioning projections 51*c* serve to prevent the center positions of the surrounding wire insertion holes 52*a* from being deviated by the elastic deformation of the seal member 52.

On the other hand, Applicants have proposed a seal member in a second conventional example, as illustrated in FIG. 5 (refer to JP H04-058975 U). The seal member 60 of the second conventional example accommodated in the connector housing 70 is made of rubber and includes a number of wire insertion holes 60*a* arranged in parallel along both directions orthogonal to each other. In the seal member 60 of the second conventional example, partition grooves 60*b* are formed between all of the adjoining wire insertion holes 60*a*. Due to the provision of the partition grooves 60*b*, the seal member 60 of the second conventional example has its wall thickness between the adjoining wire insertion holes 60*a* formed thinly. With this arrangement, even if the seal member 60 is deformed elastically since the wire insertion hole 60*a* is enlarged in its diameters by an inserted wire, it is possible to prevent the center positions of the surrounding wire insertion holes 60*a* from being deviated, to the utmost.

SUMMARY

In the first conventional example, however, as it is necessary to provide the seal member 52 with the positioning holes 52*b*, the first connector housing 51 with the positioning projections 51*c*, and the second connector housing 52 with the positioning projections (not illustrated), the structure of the seal member is complicated.

In the second conventional example, meanwhile, as the wall thickness of the seal member around each wire insertion hole 60*a* has a great influence on the sealing performance, the partition grooves 60*b* have to be formed while ensuring the wall thickness of the seal member to some extent. For this reason, it is required to widen the pitch of the wire insertion holes 60*a*, thereby causing the upsizing of the seal member 60 and thus the upsizing of a connector.

In consideration of the above-mentioned situation, an object of the present application is to provide a seal member which is capable of preventing the deviations of the center positions of the wire insertion holes to the utmost while maintaining miniaturization of a connector as possible and additionally, another object of the present application is to provide a connector using such a seal member.

A seal member according to a first aspect of the present application includes a plurality of wire insertion holes arranged in parallel along both directions orthogonal to each other, a plurality of block parts each of which is divided to a block having two or more of the plurality of wire insertion holes, and a connecting part which is configured so as to connect between the adjoining block parts and have a thickness thinner than wall thicknesses of the block parts.

A connector according to a second aspect of the present application includes: a connector housing including a plurality of terminal accommodating chambers arranged in parallel along both directions orthogonal to each other, and a seal-member accommodating chamber communicating with the plurality of terminal accommodating chambers; a seal member accommodated in the seal-member accommodating chamber, the seal member including wire insertion holes arranged in positions corresponding to the terminal accommodating chambers respectively, a plurality of block parts each of which is divided to a block having two or more of the wire insertion holes, and a connecting part which is configured so as to connect between the adjoining block parts and have a thickness thinner than wall thicknesses of the block parts; terminals accommodated in the terminal accommodating chambers; and wires connected to the terminals respectively and closely inserted into the wire insertion holes respectively.

With the seal member according to the first aspect of the present application and the connector according to the second aspect of the present application, it is possible to prevent the deviations of the center positions of the wire insertion holes while maintaining the miniaturization of the connector.

DETAILED DESCRIPTION

An embodiment will be described with reference to FIGS. 1 to 3.

Figure 1:
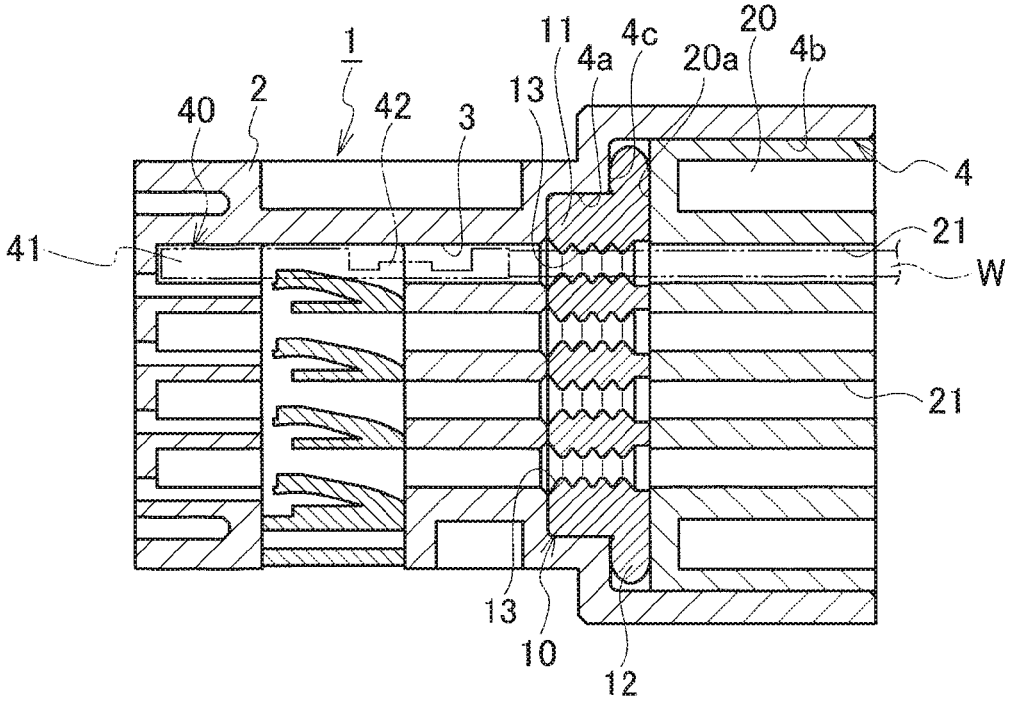
FIG. 1 is a sectional view of a connector according to an embodiment.

As illustrated in FIG. 1, a connector 1 according to the embodiment includes a connector housing 2, a mat seal 10 as a seal member accommodated in the connector housing 2, a rear holder 20 arranged behind the mat seal 10 to hold the mat seal 10, and terminals 40 each connected to a wire W and fitted to the connector housing 2.

Figure 2:
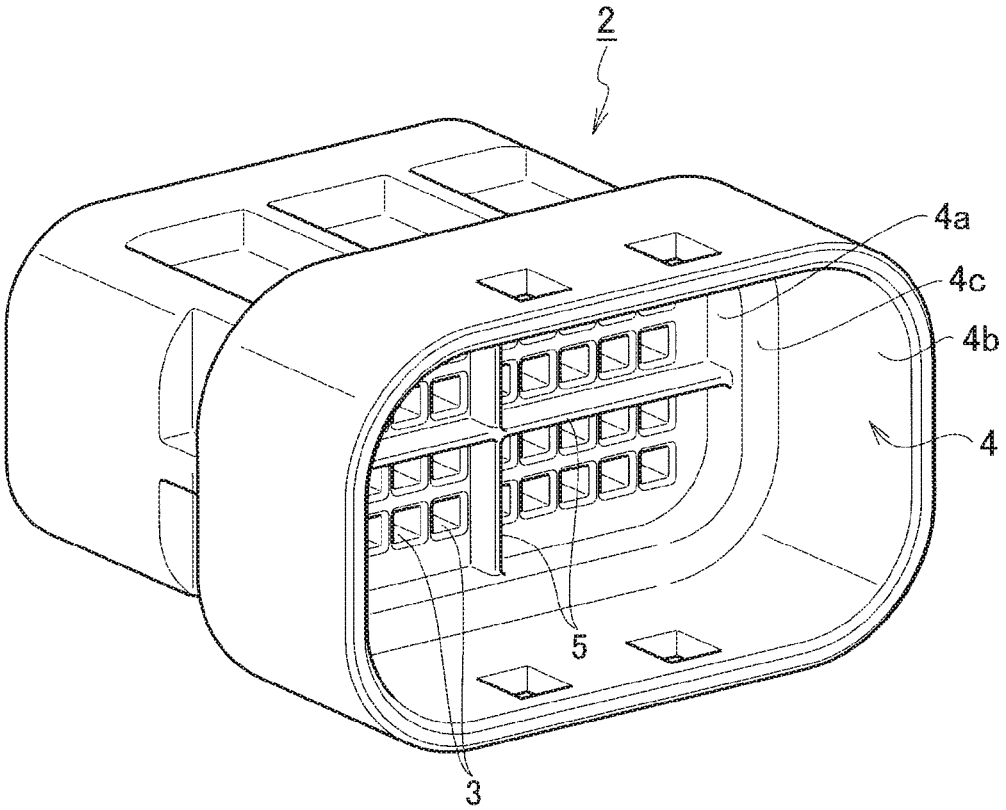
FIG. 2 is a perspective rear view of a connector housing of the connector according to the embodiment.
Figure 3A:
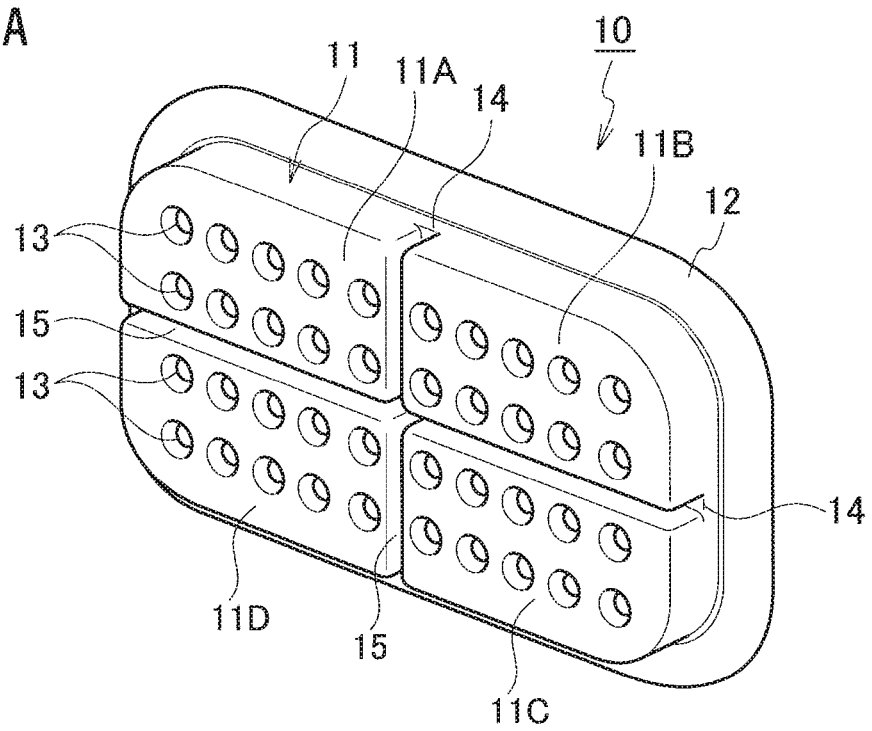
FIG. 3A is a perspective view of a mat seal of the connector according to the embodiment.
Figure 3B:
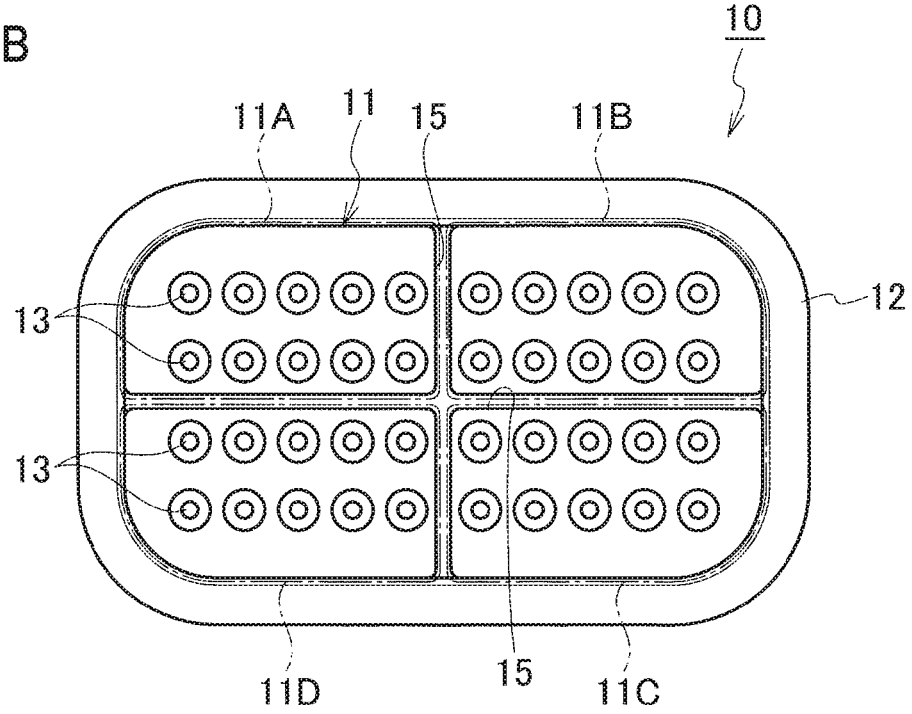
FIG. 3B is a front view of the mat seal of the connector according to the embodiment.
Figure 4:
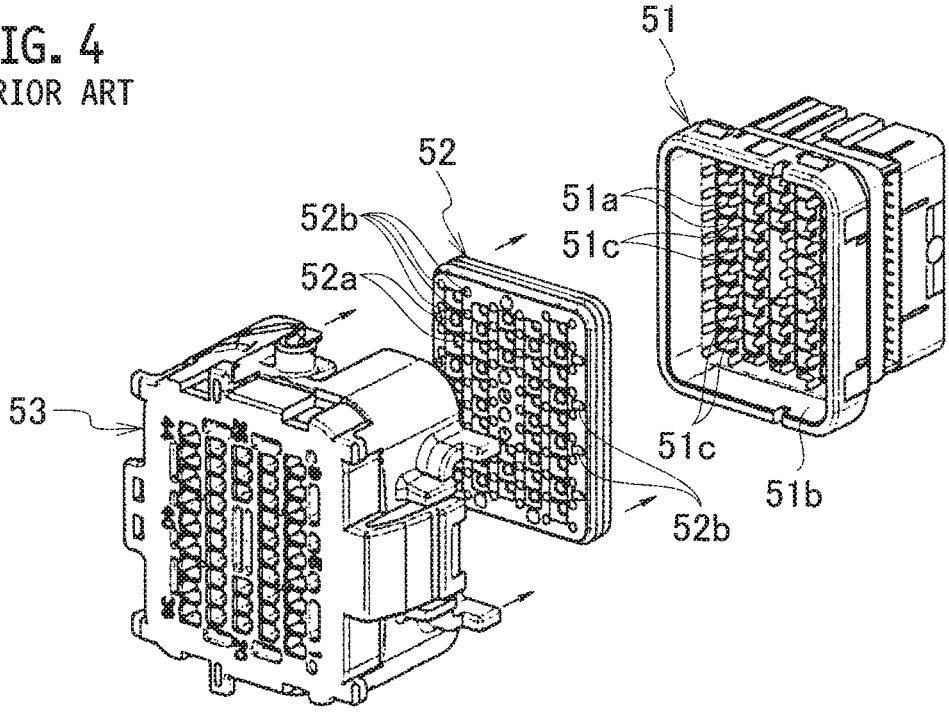
FIG. 4 PRIOR ART
FIG. 4 is a perspective view of a connector in a first conventional example.
Figure 5:
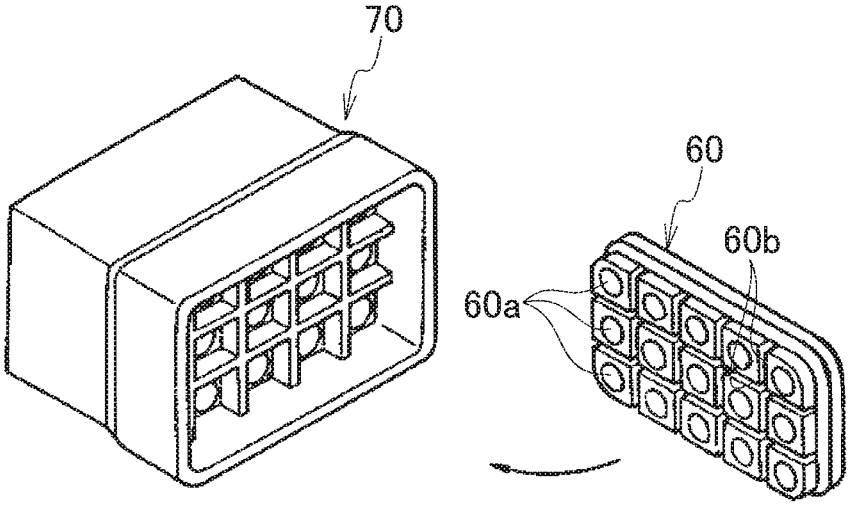
FIG. 5 PRIOR ART
FIG. 5 is an exploded perspective view of a connector in a second conventional example.

As illustrated in FIGS. 1 and 2, the connector housing 2 includes a plurality of terminal accommodating chambers 3 and a mat-seal accommodating chamber 4 arranged behind the terminal accommodating chambers 3 (on the wire draw-out side of the chambers 3). A rear chamber section 4*b* of the mat-seal accommodating chamber 4 is formed broader than a front chamber section 4*a* of the mat-seal accommodating chamber 4 over the entire circumference of the mat-seal accommodating chamber 4. Thus, on a boundary between the front chamber section 4*a* and the rear chamber section 4*b*, a pressing surface 4*c* is formed by a step-shaped wall surface.

In the embodiment, four counterpart connectors (not illustrated) are fitted into the connector housing 2. The mat-seal accommodating chamber 4 is provided, on the side of the terminal accommodating chambers 3, with partition walls 5 (see FIG. 2) corresponding to the fitting areas of the counterpart connectors.

The mat seal 10 is accommodated in the mat-seal accommodating chamber 4, as illustrated in FIG. 1. The mat seal 10 is made of softer elastic material, such as rubber. The mat seal 10 includes a mat-seal body 11 for holding the wire W and a housing-seal part 12 projecting from the entire circumference of the mat-seal body 11 outward. In the mat seal 10, its portion located at the front side than the front face of the housing-seal part 12 is arranged in the front chamber section 4*a*, while a mat-seal portion located at the rear side than the front face of the housing-seal part 12 is arranged in the rear chamber section 4*b* of the mat-seal accommodating chamber 4. The housing-seal part 12 has one end formed with an arc shaped cross section. The housing-seal part 12 is pinched between the pressing surface 4*c* of the connector housing 2 and a front face 20*a* of the rear holder 20. The mat-seal accommodating chamber 4 of the connector housing 2 has an inner circumferential face waterproofed by an outer circumference of the mat seal 10.

The mat-seal body 11 has a plurality of wire insertion holes 13 formed at respective positions corresponding to the terminal accommodating chambers 3, in other words, the wire insertion holes 13 arranged in parallel at intervals along both directions orthogonal to each other. On the inner circumferential face of each of the wire insertion holes 13, a plurality of projective peripheral lips (indicated with no reference numeral) are provided at intervals in the axial direction of the wire insertion hole 13. Each of the projective peripheral lips is formed so that its inner diameter gets smaller than the outer diameter of the wire W.

In the mat-seal body 11, the whole of the wire insertion holes 13 is divided into a plurality of block parts 11A-11D. Each of the block parts 11A-11D includes at least multiple wire insertion holes 13. In the illustrated embodiment, there are provided four block parts 11A-11D each of which includes ten (2 rows by 5 lines) wire insertion holes 13. The size of each block part 11A-11D (namely, the number of wire insertion holes 13) is established so that, in every inserting situation of the wires W, the deviations of the center positions of all the other wire insertion holes 13 where the wires have not been inserted yet (i.e. unoccupied wire insertion holes) stay within a predetermined allowable range.

The adjoining block parts 11A-11D are connected with each other through connecting parts 14 each of which has a thickness thinner than the wall thicknesses of the block part 11A-11D. In other words, between the adjoining block parts 11A-11D, there are partition grooves 15 defined by the thin-walled connecting parts 14. In arrangement, the partition walls 5 of the connector housing 2 are disposed between the adjoining block parts 11A-11D, namely, in the partition grooves 15.

The plurality of counterpart connectors is fitted into the connector housing 2. Corresponding to the fitting areas of the respective counterpart connectors, the mat seal 10 is divided into the block parts 11A-11D. As the embodiment assumes four counterpart connectors, the mat seal 10 is divided into four block parts 11A-11D. Each of the block part 11A-11D satisfies a condition where the deviations of the center positions of the wire insertion holes 13 of the same block part 11A-11D stay within the allowable range.

In assembling, the rear holder 20 is inserted into the mat-seal accommodating chamber 4 from the rear side of the connector housing 2. The rear holder 20 has an outline size allowing its insertion into the rear chamber section 4*b* of the mat-seal accommodating chamber 4 without substantially producing any clearance. As mentioned before, the periphery of the front face of the rear holder 20 is closely adhered to the housing-seal part 12 of the mat seal 10. In the rear holder 20, wire slots 21 are formed at respective positions corresponding to the respective wire insertion holes 13 of the mat seal 10. Each of the wire slots 21 has a slot size larger than the outline size of the terminal 40.

On the other hand, as illustrated with an imaginary line of FIG. 1, the terminal 40 has a counterpart-connector connecting part 41 for contacting with the counterpart connector and a wire connecting part 42 formed integrally with the counterpart-connector connecting part 41. The counterpart-connector connecting part 41 has an outline in the form of a rectangular box. One end of the wire W is connected to the wire connecting part 42 by crimping. The terminal 40 is arranged in the terminal accommodating chamber 3 of the connector housing 2. The wire W is led out from the rear face of the connector housing 2 through the wire insertion hole 13 of the mat seal 10 and the wire slot 21 of the rear holder 20.

With the arrangement mentioned above, the inner circumferential face of the mat-seal accommodating chamber 4 of the connector housing 2 is waterproofed by the housing-seal part 12 of the mat seal 10. Further, both the inner circumferential face of the wire insertion hole 13 of the mat seal 10 and the wire W are waterproofed since the inner circumferential face of the wire insertion hole 13 closely adheres to the outer periphery of the wire W.

Next, the fitting of the terminal 40 will be described. The terminal 40 connected to the wire W is fitted to the connector housing 2 after fitting the mat seal 10 and the rear holder 20 to the connector housing 2. The terminal 40 is inserted into the wire slot 21 of the rear holder 20 from the rear side and further inserted into the wire insertion hole 13 of the mat seal 10. In the process of inserting the terminal 40 into the wire insertion hole 13, an insertion tip of the terminal 40 gradually enters into the wire insertion hole 13 while stretching and expanding the wire insertion hole 13. Once the terminal 40 is inserted up to a predetermined position of the terminal accommodating chamber 3, the insertion of the terminal 40 into the wire insertion hole 13 is completed.

When the wire W is closely accommodated in the wire insertion hole 13, the mat seal 10 is elastically deformed so that the wire insertion hole 13 widens its diameter since the diameter of the wire W is larger than the diameter of the inner circumferential face of the wire insertion hole 13. Nevertheless, for instance, when the wires W are closely inserted into the wire insertion holes 13 in the first block part 11A, the elastic deformation of the mat seal 10 stays in the first block part 11A and exerts little influence on the second to fourth block parts 11B-11D. Additionally, even in the first block part 11A, the deviations of the center positions of the other wire insertion holes 13 stay within the allowable range. Therefore, it is possible to execute the subsequent fitting operation of the terminals 40 smoothly.

As mentioned above, the mat seal 10 includes the plurality of wire insertion holes 13, the plurality of divided block parts 11A-11D, each of which is formed so as to have two or more wire insertion holes 13, and the connecting parts 14 each having a thickness thinner than the wall thicknesses of the block parts 11A-11D, the connecting parts 14 connecting the plurality of divided block parts 11A-11D with the adjoining block parts 11A-11D. The elastic deformation of the mat seal 10 under condition that the wires W are closely inserted into the wire insertion holes 13 stays in the relevant block part (e.g. the first block part 11A) and exerts little influence on the other block parts (e.g. the second to fourth block parts 11B-11D). Thus, it is possible to prevent the deviations of the center positions of the wire insertion holes 13 to the utmost. Although the mat-seal's portion around the wire insertion holes 13 has to ensure a thickness to some extent in view of its great influence on the sealing performance, it is possible to narrow the pitch of the wire insertion holes 13 within an area of a single block part 11A-11D since a plurality of wire insertion holes 18 are formed in the single block part 11A-11D, thereby allowing the miniaturization of the connector 1 to be maintained to the utmost. From above, it is possible to prevent the deviations of the center positions of the wire insertion holes 13 to the utmost while maintaining the miniaturization of the connector 1 as possible.

Between the adjoining block parts 11A-11D, namely, in the partition grooves 15, there are arranged the partition walls 5 of the connector housing 2. Therefore, for instance, even if the wires W closely inserted into the wire insertion holes 13 in the first block part 11A are about to cause the other block parts 11B-11D to be deformed elastically, the partition walls 5 serve to suppress such an elastic deformation. Thus, it is possible to prevent the deviations of the center positions of the wire insertion holes 13 in the other block parts 11B-11D reliably.

There are provided the plurality of counterpart connectors to be fitted to the connector housing 2 and therefore, the mat seal 10 is divided into the block parts 11A-11D corresponding to the fitting areas of the respective counterpart connectors. Accordingly, it is possible to unify the pitch of the wire insertion holes 13 in each block part 11A-11D and thus pitch of the terminal accommodating chambers 3, to an extremely narrow pitch. In other words, if the fitting areas of the respective counterpart connectors do not correspond to the block parts 11A-11D, the width dimensions of the connecting parts 14 (the partition walls 15) between the adjoining block parts 11A-11D would obstruct the reduction of the pitch interval of the wire insertion holes 13 and also cause the mat seal 10 and thus the connector 1 to be large-sized.

Although the connector housing 2 is directed to its engagement with a plurality of counterpart connectors in the connector 1 of the illustrated embodiment, the engagement may be modified for a single counterpart connector in a modification. Then, the connector 1 and the counterpart connector are fitted to each other one-to-one. In the fitting condition of the connectors, respective terminals (not illustrated) of the counterpart connector are connected to the terminals 40 of the plurality of block parts 11A-11D, respectively.

In connection, although the mat seal 10 is divided into four block parts 11A-11D in the connector 1 of the embodiment, the mat seal 10 may be divided into two or three block parts and alternatively, it may be divided into five or more block parts.

What is claimed is:

1. A seal member, comprising:

a plurality of wire insertion holes arranged in parallel along both directions orthogonal to each other;

a plurality of block parts each of which is divided to a block having two or more of the plurality of wire insertion holes; and a connecting part which is configured so as to connect between the adjoining block parts and have a thickness thinner than wall thicknesses of the block parts, wherein a size of each of the plurality of block parts is established to reduce, in a condition in which a wire is inserted into one of the plurality of wire insertion holes, a deviation of a center position of one or more of others of the plurality of wire insertion holes.

2. The seal member of claim 1, wherein under a condition that the seal member is accommodated in a connector housing, a partition wall of the connector housing is arranged in the connecting part.

3. A connector, comprising:

a connector housing comprising a plurality of terminal accommodating chambers arranged in parallel along both directions orthogonal to each other, and a seal-member accommodating chamber communicating with the plurality of terminal accommodating chambers;

a seal member accommodated in the seal-member accommodating chamber, the seal member comprising a plurality of wire insertion holes arranged in positions corresponding to the terminal accommodating chambers respectively, a plurality of block parts each of which is divided to a block having two or more of the wire insertion holes, and a connecting part which is configured so as to connect between the adjoining block parts and have a thickness thinner than wall thicknesses of the block parts;

terminals accommodated in the terminal accommodating chambers; and wires connected to the terminals respectively and closely inserted into the wire insertion holes respectively, wherein a size of each of the plurality of block parts is established to reduce, in a condition in which a wire of the wires is inserted into one of the plurality of wire insertion holes, a deviation of a center position of one or more of others of the plurality of wire insertion holes.

4. The connector of claim 3, wherein the connector housing is provided with a partition wall, and the partition wall is arranged between the adjoining block parts.

5. The connector of claim 3, wherein the connector housing is adapted so as to fit a plurality of counterpart connectors, and the block parts are divided corresponding to fitting areas of the counterpart connectors.

6. The connector of claim 3, wherein a rear chamber section of the seal-member accommodating chamber is broader than a front chamber section of the seal-member accommodating chamber over the entire circumference of the seal-member accommodating chamber such that a pressing surface is formed by a step-shaped wall surface at a boundary between the front chamber section and the rear chamber section.

7. The connector of claim 3, wherein the seal member includes a seal member body for holding the wires and a housing-seal part projecting outward from the entire circumference of the seal member body.

8. The connector of claim 3, wherein the seal-member accommodating chamber is provided on the side of the terminal accommodating chambers, with partition walls corresponding to fitting areas of the counterpart connectors.

9. The connector of claim 3, wherein the seal member is made of a soft elastic material.

10. The connector of claim 3, wherein the plurality of wire insertion holes are arranged in parallel at intervals along both directions orthogonal to each other.

11. The connector of claim 3, wherein a plurality of projective peripheral lips are provided on an inner circumferential face of each of the wire insertion holes at intervals in an axial direction of insertion of the wires.

12. The connector of claim 11, wherein each of the projective peripheral lips is formed such that an inner diameter of the wire insertion hole is smaller than an outer diameter of a respective one of the wires.

13. The connector of claim 3, wherein the size of each of the plurality of block parts is set so as to satisfy a condition in which the deviation of the center position of the one or more of the wire insertion holes remains within a predetermined range in the condition in which the wire of the wires is inserted.

14. The seal member of claim 1, wherein the size of each of the plurality of block parts is set so as to satisfy a condition in which the deviation of the center position of the one or more of the wire insertion holes remains within a predetermined range in the condition in which the wire of the wires is inserted.

* * * * *